United States Patent [19]

West et al.

[11] Patent Number: 4,487,113

[45] Date of Patent: Dec. 11, 1984

[54] VENT ASSEMBLY AND METHOD OF MAKING SAME

[75] Inventors: David W. West, Peru; Lonnie R. Hazel, Kokomo; John M. Frederick, Peru, all of Ind.

[73] Assignee: Square D Company, Palatine, Ill.

[21] Appl. No.: 373,369

[22] Filed: Apr. 30, 1982

[51] Int. Cl.[3] ..... F24F 7/00

[52] U.S. Cl. ..... 98/121 R; 228/135; 228/182

[58] Field of Search ..... 29/160; 52/473; 98/121 R; 228/135, 182

[56] References Cited

U.S. PATENT DOCUMENTS

| | | | |
|---|---|---|---|
| 2,799,085 | 7/1957 | Baker et al. | 228/182 |
| 3,291,962 | 12/1966 | Walker | 228/182 X |
| 3,530,781 | 9/1970 | Kesinger | 98/121 R X |

FOREIGN PATENT DOCUMENTS

| | | | |
|---|---|---|---|
| 2415581 | 10/1975 | Fed. Rep. of Germany | 98/121 R |
| 542679 | 1/1942 | United Kingdom | 98/121 R |
| 544204 | 4/1942 | United Kingdom | 98/121 R |

*Primary Examiner*—Harold Joyce

*Attorney, Agent, or Firm*—Larry I. Golden; Richard T. Guttman

[57] ABSTRACT

A barrier vent assembly formed of a plurality of V-shaped baffles secured between two spaced frame members. The V-shaped baffles are nestled one within the other to prevent straight line access through the vent openings. The baffles have mounting tabs at their opposite ends which are received within mating slots contained in the frame members. Because of this arrangement, all of the tabs may be welded to the frame member by a single continuous weld bead.

2 Claims, 7 Drawing Figures

FIG. 1c
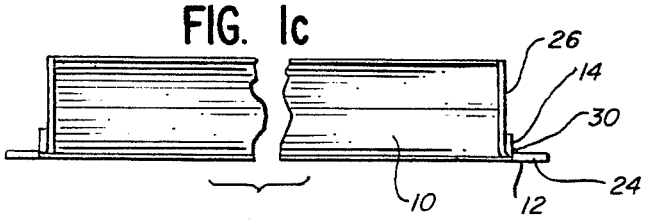
FIG. 1a
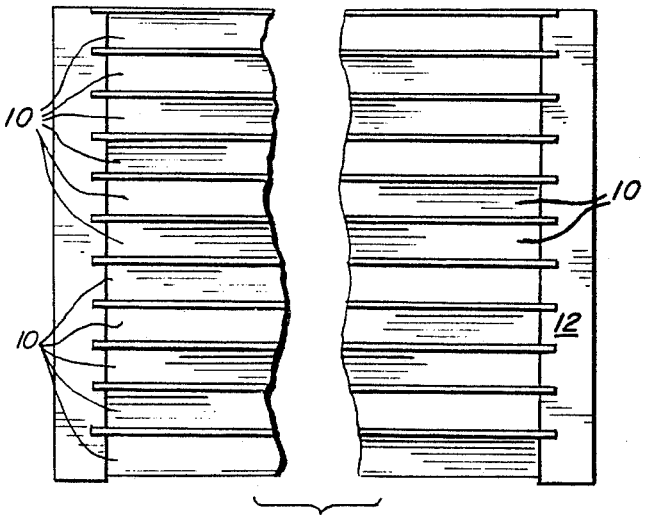
FIG. 1b
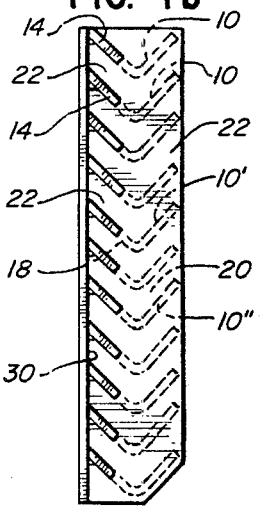
FIG. 2a
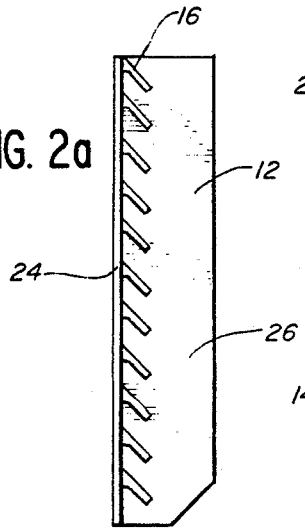
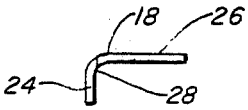
FIG. 2b
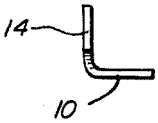
FIG. 3b
FIG. 3a
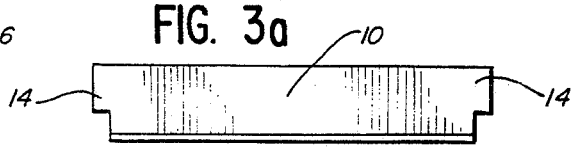

VENT ASSEMBLY AND METHOD OF MAKING SAME

BACKGROUND OF THE INVENTION

This invention generally relates to vent assemblies and methods of making same, and, particularly, to barrier vent assemblies which are constructed to prevent or hinder passage of rigid articles through the vent openings.

Vent assemblies are often required to provide air ventilation to electrical equipment or the like contained within equipment enclosures. For safety reasons, such vent assemblies are often guarded to prevent direct access through the vent openings to a live electrical part or moving mechanical part of the equipment contained within the inclosure. In particular, the Underwriters Laboratory standard for panelboard ventilating openings provides that "A ventilation opening—slot, louver, or the like—shall be protected by one or more baffles, barriers, or other obstructions of such dimensions and locations that any access path to a live part requires at least two deviations of direction from a straight line." (see UL Standard 67, Section 5.14).

Known designs for meeting this standard have included baffled vent openings with barrier plates or the like mounted in a location spaced from and behind the baffles to block direct or straight line access. Other designs employ a wire mesh in lieu of the barrier plate. Designs are also known which employ a pair of members mounted adjacent the vent opening in cooperative blocking relationship.

These designs achieve the desired objective of access. Unfortunately, the many parts and their arrangement requires the making of numerous weld joints during assembly which adds to the costs of labor and materials in constructing the vent assemblies. In addition, some of these designs result in an undesirably thick, or high profile, vent assembly.

SUMMARY OF THE INVENTION

The principal object of the present invention is the provision of a barrier vent assembly which is simpler in construction and easier to assemble than known barrier vent assemblies.

In keeping with this objective, a vent assembly is provided in which the baffles alone perform the barrier function without the need for a barrier plate or the like spaced from the baffles. In particular, a frame and a plurality of elongate baffles mounted to the frame are provided in which the baffles having a cross-sectional shape and relative spacing between one another which prevents the straight line passage of objects between the baffles.

In a preferred form, the baffles are substantially V-shaped in cross-section and are sufficiently nestled together to create a barrier to straight line access between the baffles and through the vent opening.

Another object of my invention is the provision of a vent assembly of either the barrier or non-barrier type and a method of making same in which a plurality of elongate baffles are secured at their ends to a frame member by means of a single weld bead.

In the preferred embodiment, mounting tabs at the ends of the baffles extend through and are held within mating slots in the frame member while the tabs are all welded to the frame by means of a single welding action.

BRIEF DESCRIPTION OF THE DRAWINGS

The foregoing features and advantages will be described in greater detail and further features and advantages will be made apparent in the following detailed description of the preferred embodiment which is given with reference to the several views of the drawings, in which:

FIG. 1A is a front view of the barrier vent assembly with a central portion broken out;

FIG. 1B is a side view of the barrier vent assembly of FIG. 1A and showing the continuous weld bead and mounting tab;

FIG. 1C is a plan view of the assembly of FIG. 1A;

FIG. 2A is a side view of one of the frame members of the assembly of FIGS. 1A–1C;

FIG. 2B is a plan view of the frame member of FIG. 2A;

FIG. 3A is a side view of one of the baffles with mounting tabs; and

FIG. 3B is an end view of the baffle of FIG. 3A.

DETAILED DESCRIPTION

Referring first to FIGS. 1A, 1B and 1C, the barrier vent assembly is seen to comprise a plurality of baffles 10 mounted in spaced, parallel relationship with respect to one another between a pair of spaced, parallel frame members 12. Each baffle includes a pair of leg portions. As also seen in FIGS. 3A and 3B, the baffles 10 are V-shaped in cross-section and have mounting tabs 14 at their opposite ends. Advantageously, this V-shape gives the baffles greater rigidity. The tabs 14 are snuggly received within associated mating slots 16 contained with the frame members 12, as also seen in FIG. 2A.

In accordance with the principal object of the invention, the baffles 10 are associated in nestled relationship with respect to one another. When the baffles 10 are mounted with their tabs 14 within their associated mating slots 16, the bottom or point of the V of one V-shaped baffle 10 extends into the open end of the baffle 10 adjacent thereto. For instance, referring to FIG. 1B, a baffle 10' is seen to have its point 18 extend into the open end 20 of the adjacent baffle 10''. This nestling relationship between adjacent baffles prevents straight line access through the vent openings 22, such as illustrated by broken line 24 of FIG. 1B.

As seen in FIGS. 2A and 2B, the frame members 12 have an L-shaped cross-section formed by two arms 24 and 26 which define an internal corner 28. The slots 16 are formed adjacent corner 28.

During assembly, after all of the tabs 14 have been inserted through their associated slots 16, a continuous arc welding action can be utilized to weld all the tabs 14 to arm 24 at corner 28. Thus, because of this arrangement, spot welding, which is a much slower process, is not required. Instead, a single weld bead 30 is created which extends along the entire length of the frame members 12 and secures all of the baffles 10 thereto.

The slots 16 hold the baffles 10 securely in their proper location during the welding process. The L-shaped cross-section of frame 12 provides additional lateral rigidity, to compensate for the slots 16 which tend to weaken the frame. Arm 24 is also used to subsequently mount the entire frame assembly over a vent opening. When mounted, arm 24 is located flush against a panel surrounding the opening and spot welded or otherwise secured thereto.

While one of the preferred embodiments of the invention has been disclosed in detail, it should be appreciated that many variations may be made with respect thereto without departing from the scope of the invention as defined in the appended claims. For instance, although the baffles 10 are shown as being V-shaped, U-shaped or any other like configuration which is capable of having one baffle nestled within another would be suitable.

We claim:

1. A vent assembly for use in association with an opening in a panel, comprising:

a pair of elongate substantially L-shaped frame members having an internal corner and opposite arms, said frame members provided with a plurality of parallel mating slots adjacent said internal corner;

a plurality of baffles extending between said frame members, said baffles having a substantially V-shaped cross section and the baffles having at opposite ends mounting tabs received within said mating slots, said tabs each extending through their respective slots and outward from said slot adjacent said internal corner, adjacent baffles being in nestled relationship which prevents the straight line passage of an object through the assembly between the baffles; and a single bead weld forming a substantially straight line adjacent the internal corner of each frame member securing said tabs to said frame.

2. A method of making a vent assembly comprising the steps of: forming a plurality of generally V-shaped baffles with mounting tabs on opposite ends of the baffles, inserting said mounting tabs through corresponding slots in a pair of generally L-shaped opposite frame members having an internal corner;

securing said tabs to their associated frame members by means of a single straight line weld along the internal corner.

* * * * *